US006814308B2

(12) United States Patent
Kuo

(10) Patent No.: US 6,814,308 B2
(45) Date of Patent: Nov. 9, 2004

(54) SWITCH HANDLE USED IN WATER SPRAYER

(76) Inventor: Wen-Li Kuo, 235 Chung-Ho, Box 8-24, Taipei (TW)

( * ) Notice: Subject to any disclaimer, the term of this patent is extended or adjusted under 35 U.S.C. 154(b) by 302 days.

(21) Appl. No.: 10/016,395

(22) Filed: Dec. 17, 2001

(65) Prior Publication Data

US 2003/0111556 A1 Jun. 19, 2003

(51) Int. Cl.[7] ..... B05B 7/02; B05B 9/01; B05B 1/34

(52) U.S. Cl. ..... 239/530; 239/525; 239/526; 239/463

(58) Field of Search ..... 239/525, 526, 239/530, 569, 582.1, 463, 482, 483, 501, 581.2, 600, 1

(56) References Cited

U.S. PATENT DOCUMENTS 3,637,143 A * 1/1972 Shames et al. ..... 239/283
4,055,301 A * 10/1977 Hruby, Jr. ..... 239/589.1
4,097,020 A * 6/1978 Sussman ..... 251/10
4,717,073 A * 1/1988 Bielka ..... 239/107
5,297,739 A * 3/1994 Allen ..... 239/530
5,613,638 A * 3/1997 Blessing ..... 239/396

* cited by examiner

*Primary Examiner*—Davis Hwu

(57) ABSTRACT

A switch handle at a bottom section of a sprayer long tube of a water sprayer includes a sprayer long tube, a switch and an inlet tube having a connecting sleeve pivotally connected to a bottom end thereof. The bottom section of the long tube is connected to an outlet section of the switch. The inlet section of the switch is connected to the inlet tube. The sprayer long tube, switch and inlet tube are integrally connected. The connecting section of bottom section of the long tube and the switch, the periphery of the switch, the connecting section of the switch and the tube, and the entire peripheral surface of the tube are injection molded integrally from plastics (rubber) one or two times, to thereby effectively couple them integrally such that the plastic (rubber) injection molded parts is suitable to be used by the handle provided at the bottom section of the sprayer long tube. Hence, the handle can be prevented from rotating and sliding up and down, and the switch is provided at the front section of the handle at the bottom section of the long tube to permit the user to manipulate the switch by the hand.

2 Claims, 11 Drawing Sheets

SWITCH HANDLE USED IN WATER SPRAYER

BACKGROUND OF THE PRESENT INVENTION (a) Field of the Present Invention

The present invention relates to handles used in water sprayers, and particularly to a switch handle connected to a bottom section of a long tube of a water sprayer, wherein the switch can be manipulated directly using the hand to hold the handle during operation.

(b) Description of the Prior Art

Referring to FIGS. 1, 2, 3, and 4, a conventional water sprayer mainly includes a spray head with a front end face provided with a spout hole, a long tube 3 having a top end connected to spray head 2, a bottom section fitted with a handle 31, and a bottom end pivotally connected to a connecting sleeve 32, and a switch 4 having a rotary knob 41 on a periphery thereof, a bottom end 42 connected to a connector (not shown) of a water hose, and a top section with external threads 43 for engagement with the connecting sleeve 32 at the bottom end of the long tube 3, whereby the rotary knob 41 can be rotated to control water to flow into the long tube of the sprayer.

In use, the user has to grip the handle 31 at the bottom section of long tube 3 with one hand and use the other hand to manipulate switch 4 secured to the connecting sleeve 32 at the bottom end of long tube 3 to control water to flow into the sprayer.

However, in the above structure, since the switch 4 which controls water to flow into the sprayer is locked to the connecting sleeve 32 at the bottom end of long tube 3 via external threads 43 at the top section thereof, switch 4 may easily disengage from the bottom end of long tube 3.

In addition, since the handle 31 is generally made of plastics or rubber and is directly fitted to the bottom section of long tube 3, when the sprayer is in use, water may seep through gaps between handle 31 and bottom section of long tube 3 to cause the handle to rotate and slide up and down, making positioning difficult.

In particular, referring to FIGS. 2, 3 and 4, in practice, sprayer retailers for grouping sprayers together for display purposes would provide a sprayer securing seat A. The top side of securing seat A is provided with multiple through holes A1. A base A2 of the securing seat A is provided with positioning grooves A21 corresponding to the through holes in the vertical position. A partition block A22 is provided in each position groove A21. When multiple sprayers are inserted into the multiple through holes A1 from the top end of the securing seat A, the switch locked to the bottom end of long tube 3 and rotary knob 41 can be separately positioned with respect to the partition block A22 to thereby facilitate positioning of each sprayer in securing seat A.

However, since the sprayers are arranged in the securing seat A for display to prospective customers, and since consumers generally would inspect the sprayers before purchases, the consumers would take out the sprayers from the securing seat A. As mentioned above, the switch 4 controlling water to flow into the sprayer is locked to connecting sleeve 32 at bottom end of long tube 3 via external threads 43, when the consumer removes the sprayer from securing seat A, since switch 4 locked to bottom end of long tube 3 and rotary knob 41 thereof are partitioned by partitioning block A22 disposed in each positioning groove A21 of base A2 of securing seat A, a couple will be formed to cause switch 4 to bear a rotating force during removal of the sprayer so that, if the consumer does not wish to buy the sprayer and puts the sprayer back into securing seat A, the sprayer cannot be properly positioned in securing seat A, or worse still, switch 4 will disengage from bottom end of long tube 3.

SUMMARY OF THE INVENTION

The object of this invention is to provide a switch handle at a bottom section of a long tube of a water sprayer, in which a switch controlling flow of water into the sprayer is provided at a front end of a handle at the bottom section of the sprayer, and the long tube, switch and handle can be coupled integrally to prevent disengagement of the switch. Besides, the switch can be manipulated directly using the hand to hold the handle during operation.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
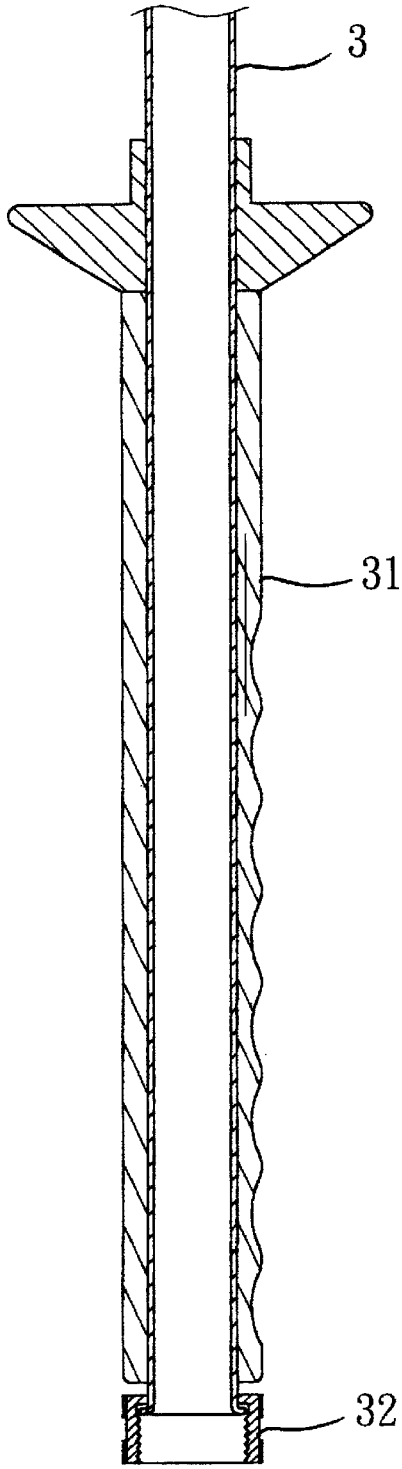
FIG. 1 PRIOR ART
FIG. 1 is a schematic sectional view illustrating assembly of a bottom section of a long tube and a handle of a conventional water sprayer.
Figure 2:
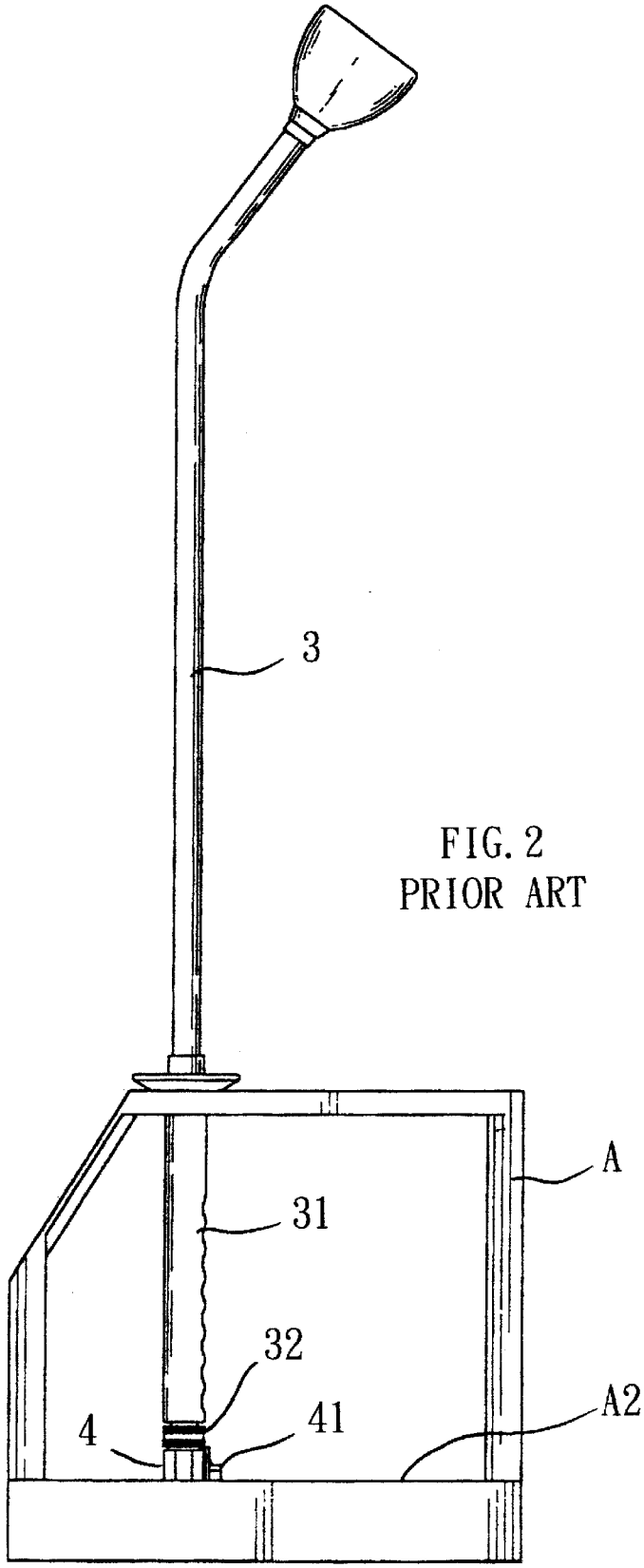
FIG. 2 PRIOR ART
FIG. 2 is a schematic view illustrating the conventional sprayer inserted into a sprayer securing seat.
Figure 3:
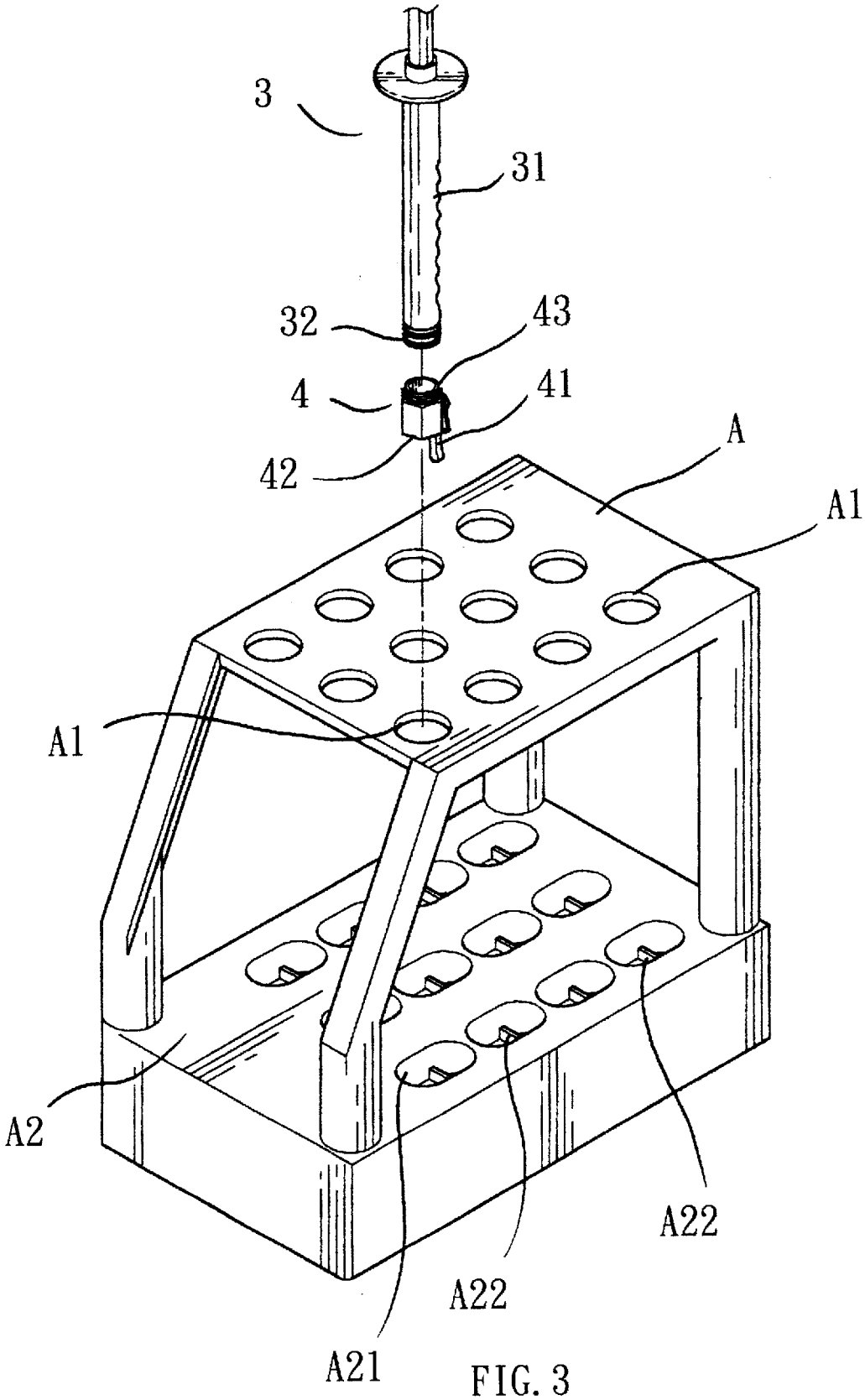
FIG. 3 PRIOR ART
FIG. 3 is a schematic exploded perspective view illustrating the bottom section of the long tube and the switch of the conventional sprayer and the securing seat.
Figure 4:
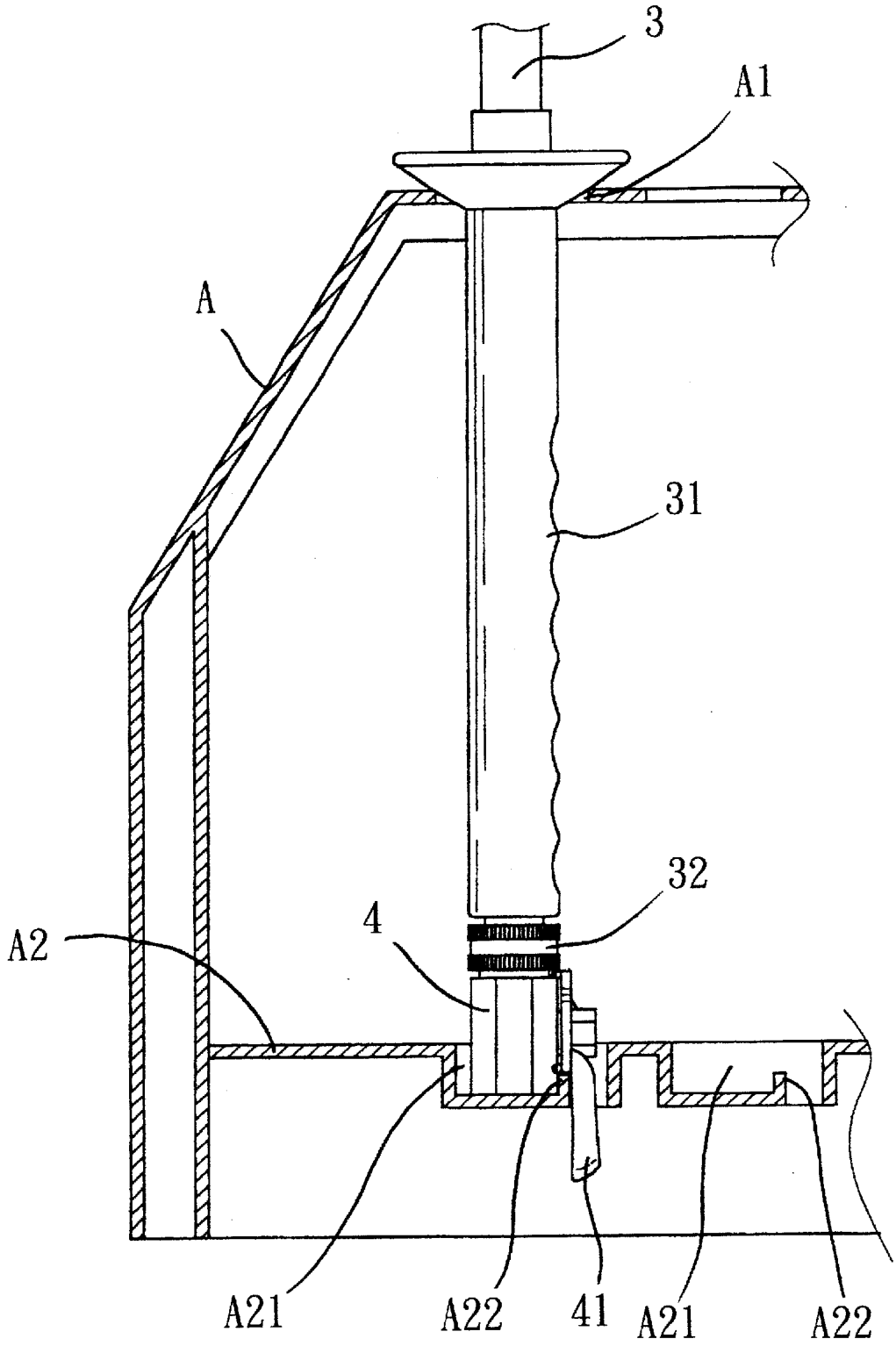
FIG. 4 PRIOR ART
FIG. 4 is a schematic sectional view illustrating assembly of the bottom section of the long tube and the switch of the conventional sprayer and the securing seat.
Figure 5:
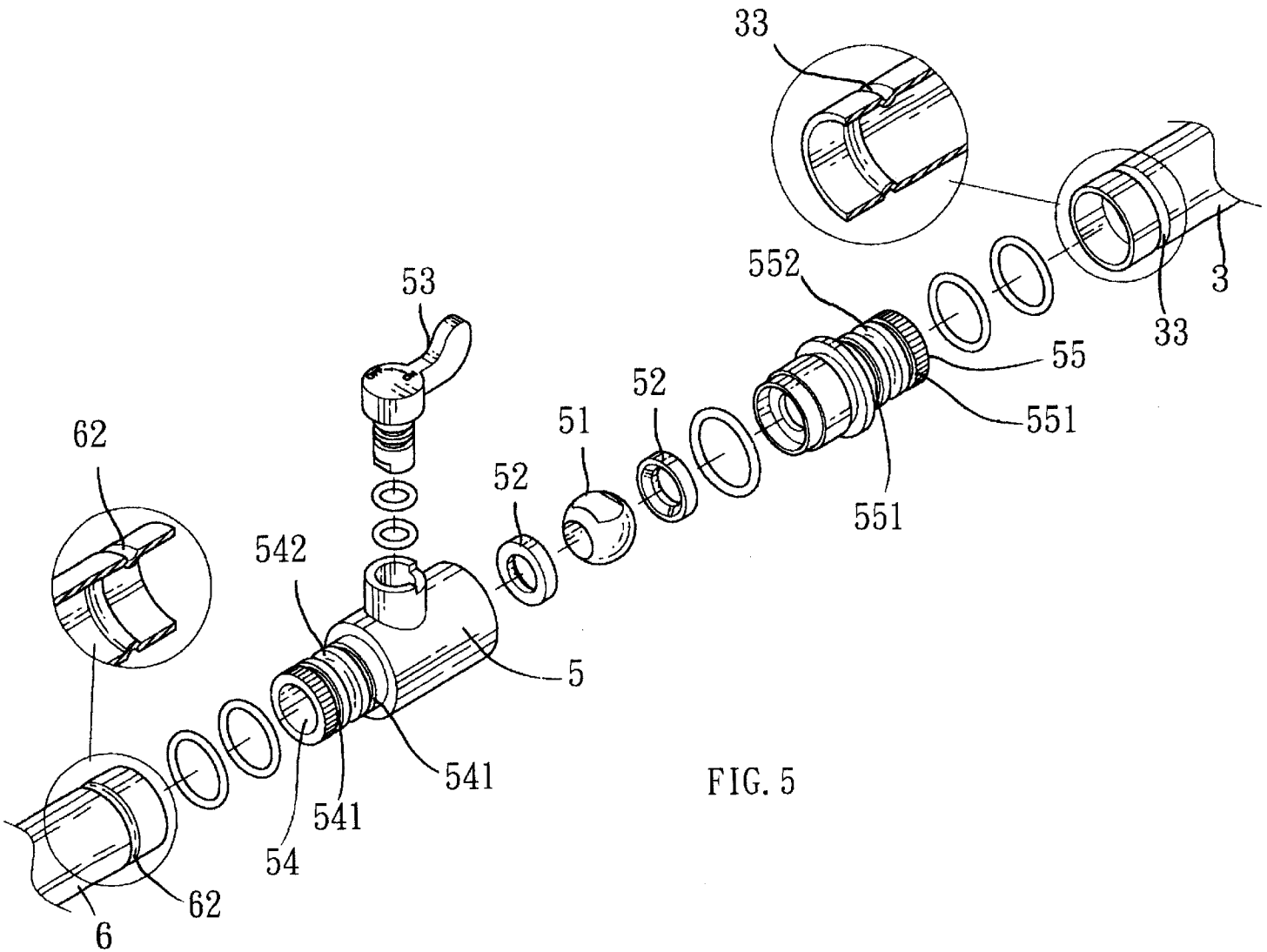
FIG. 5 is a schematic exploded view showing the bottom section of a long tube, a switch and a handle of a water sprayer according to an embodiment of this invention.
Figure 6:
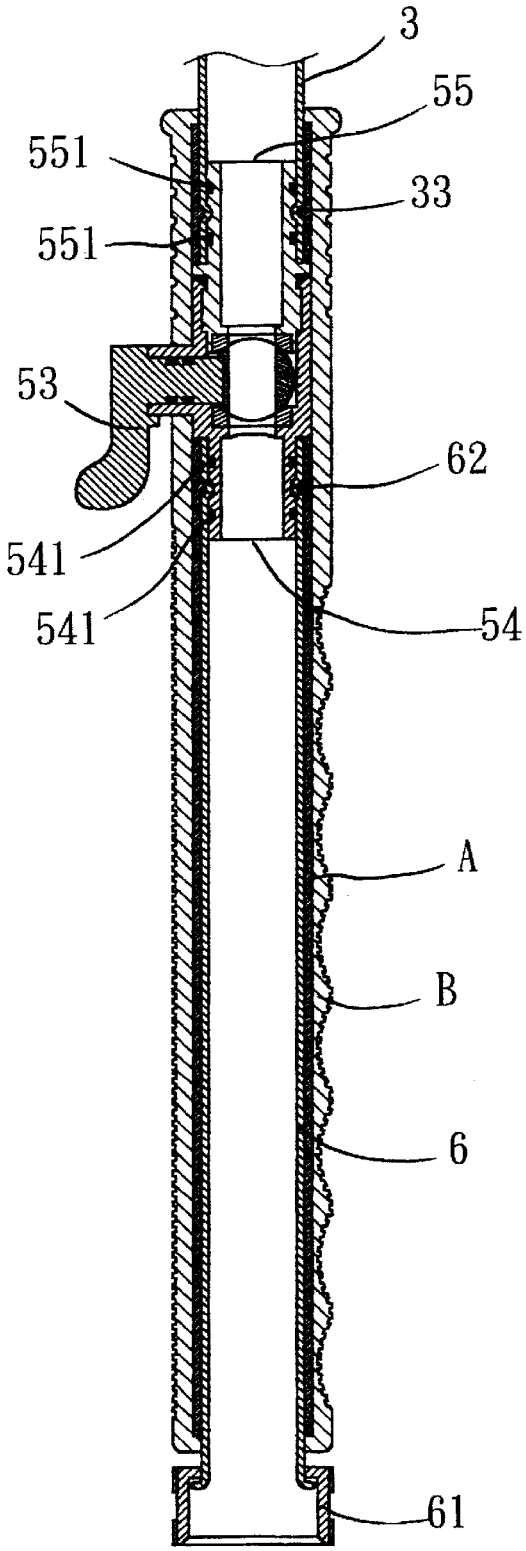
FIG. 6 is a schematic sectional view of the bottom section of the long tube, the switch and the handle of the embodiment.
Figure 7:
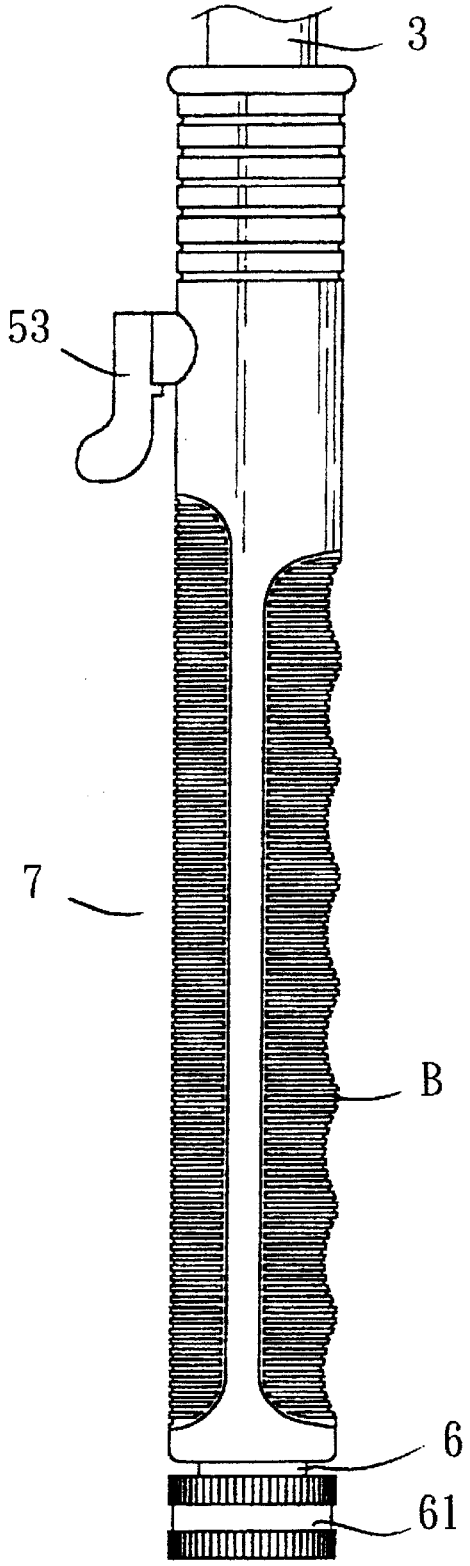
FIG. 7 is a schematic view illustrating assembly of the bottom section of the long tube, the switch and the handle of the embodiment.

Referring to FIGS. 5, 6 and 7, a switch handle at bottom section of a long tube of a sprayer according to this invention mainly includes a sprayer long tube 3, a switch 5 having an interior provided with a ball valve 51 and a water stopping packing ring 52, a rotary knob 53 disposed on the outer periphery thereof, a water inlet section 54 and an water outlet section 55 each having a suitable length, and a tube 6 with a bottom end pivotally connected to a connecting sleeve 61. The present invention is characterized in that the bottom section of long tube 3 is connected to an outlet section 55 of a switch 5, and the inlet section 54 of the switch 5 is connected to the tube 6 having a suitable length. The tube 3, switch 5 and tube 6 are connected integrally. The connecting section of the bottom section of long tube 3 and switch 5, the periphery of switch 5, the connecting section of switch 5 and inlet tube 6, and the entire peripheral surface of tube 6 are injection-molded integrally by injecting plastics (or rubber) to the portions A, B one or two times, to thereby effectively couple them integrally. Therefore, the plastic (or rubber) injection molded parts can be adapted for use by the handle 7 provided at the bottom section of the long tube 3. After finishing the integral injection of handle 7, the rotary knob 53 of the switch 5 is protruded from outer periphery of the handle 7 to provide a stopping function. Therefore, the handle 7 will not rotate or slide up and down. Besides, the switch 5 which controls water to flow into the long tube 3 can be disposed on the periphery of front section of handle 7 at the bottom section of the long tube 3 (as shown in FIGS. 6 and 7). Therefore, when it is desired to manipulate the switch 5, the user can use the hand to hold the handle 7 to directly manipulate the switch 5.

Furthermore, extending the length from inlet section 54 to the outlet section 55 of switch 5 to a suitable extent, multiple water stopping annular grooves 541, 551 for fitting of water stop rings 56, and positioning annular grooves 542, 552 can be respectively formed. The front section of the tube 6 and bottom section of the long tube 3 are respectively fitted on the peripheries of extending sections of inlet and outlet sections 54, 55 of switch 5. Corresponding to positions of positioning annular grooves 542, 552 provided on the extending sections of the inlet and outlet sections 54, 55 of the switch 5, positioning rings 33, 62 are formed so that the bottom section of the tube 61 of the handle 6 and the bottom section of the long tube 3 can be insertably coupled with the inlet and outlet sections 54, 55, thereby achieving effective connection among the long tube 3, switch 5, and tube 6. Hence, during forming the connection section of bottom section of long tube 3 and switch 5, periphery of switch 5, connecting section of switch 5 and tube 6, and the entire peripheral surface of tube 6 by injecting plastics (rubber) to A and B one time or two times, they can be effectively coupled integrally so that the injection molded parts can be used by the handle 7 at the bottom section of the long tube.

Figure 8:
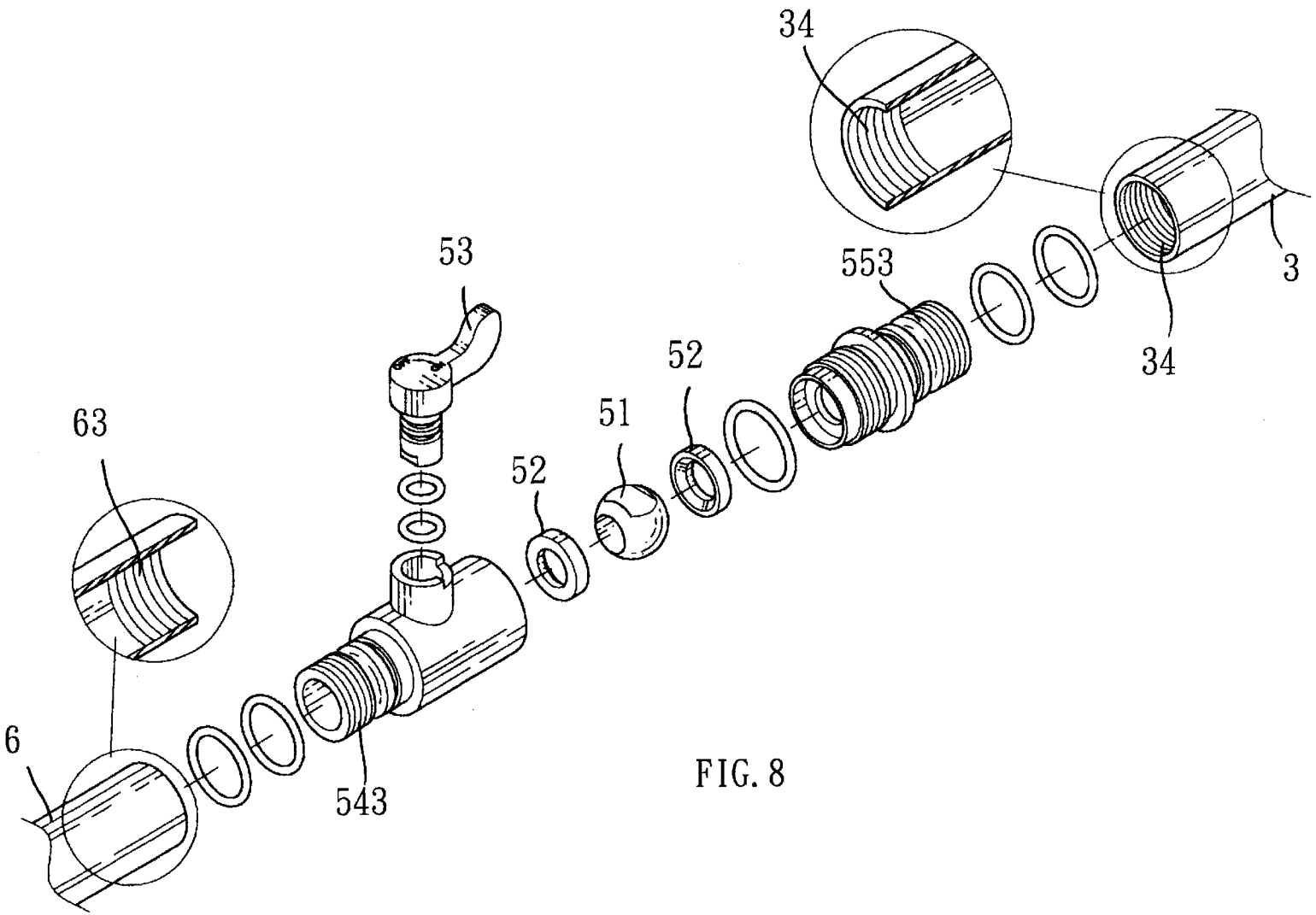
FIG. 8 is a schematic exploded view of the bottom section of a long tube, a switch and a handle of a water sprayer according to another embodiment of this invention.

Referring to FIG. 8, the extending sections of the inlet and the outlet sections 54, 55 of the switch 5 can be respectively and directly provided with threaded sections 543, 553, and front section of tube 6 and bottom section of long tube 3 can be respectively provided with threaded sections 63, 34 to achieve an effective connection among the long tube 3, switch 5, and tube 6. Hence, during integrally forming the connection section of bottom section of long tube 3 and switch 5, the periphery of the switch 5, the connecting section of the switch 5 and the tube 6, and the entire peripheral surface of tube 6 by injecting plastics (or rubber) to A and B one or two times, they can be effectively coupled integrally so that the injection molded parts can be used by the handle 7 at the bottom section of the long tube.

Figure 9:
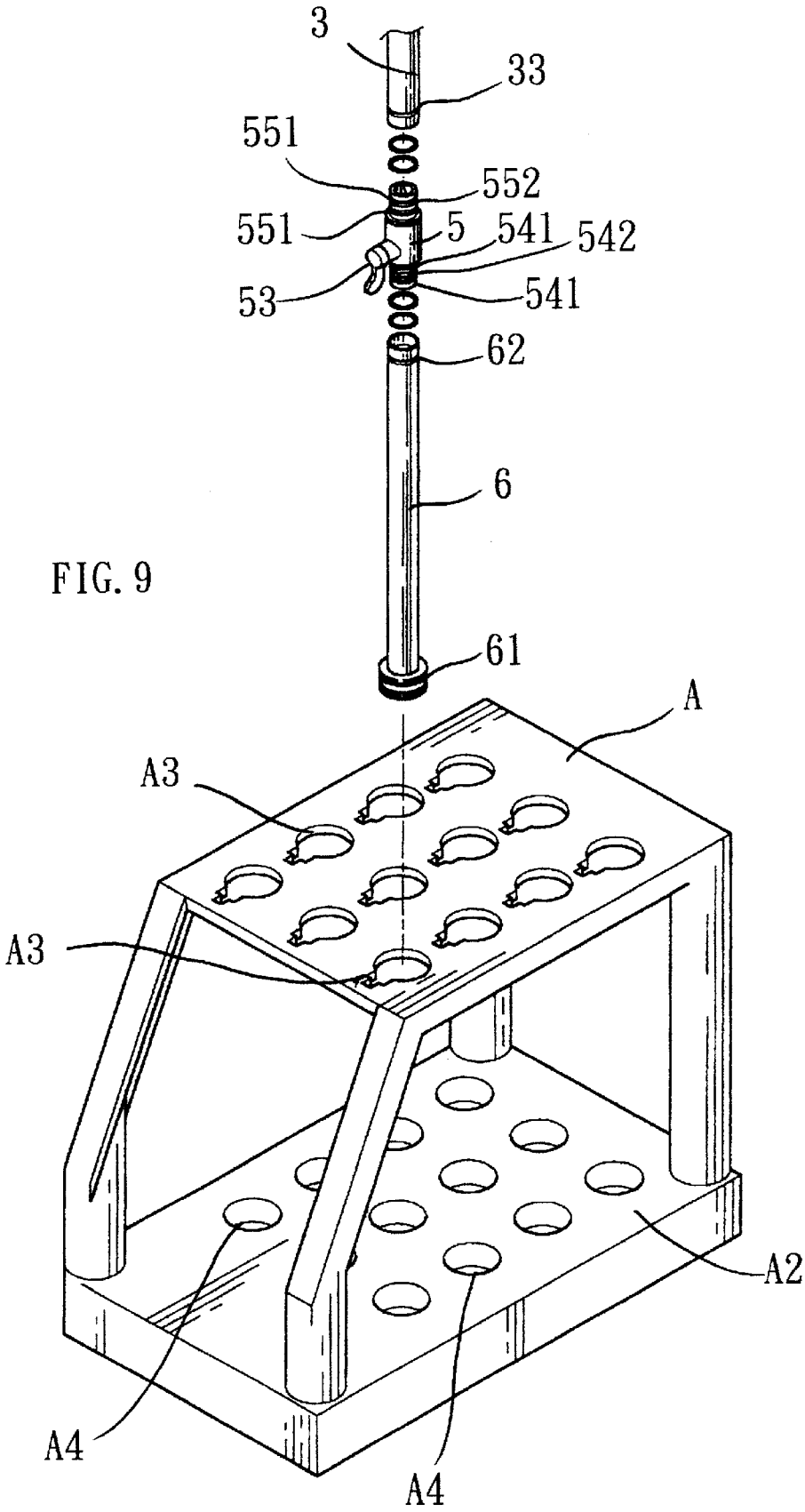
FIG. 9 is a schematic exploded perspective view of the bottom section of a long tube, a switch and a handle of a water sprayer according to this invention.
Figure 10:
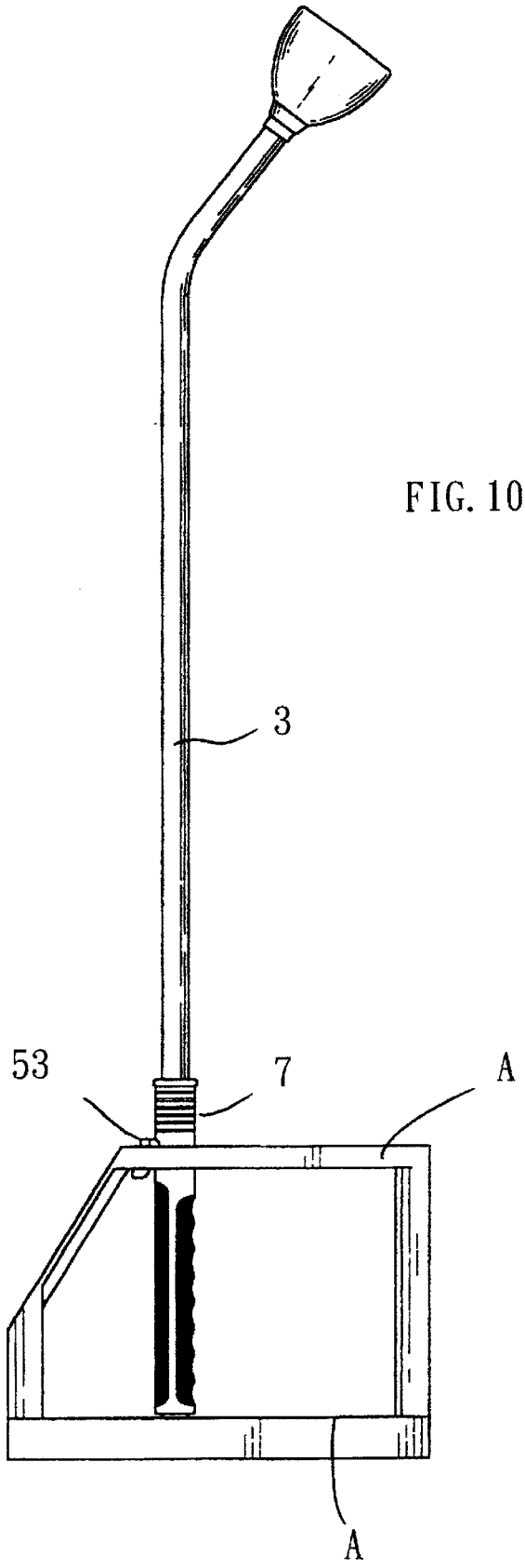
FIG. 10 is a schematic view showing the sprayer of this invention inserted into a sprayer securing seat.
Figure 11:
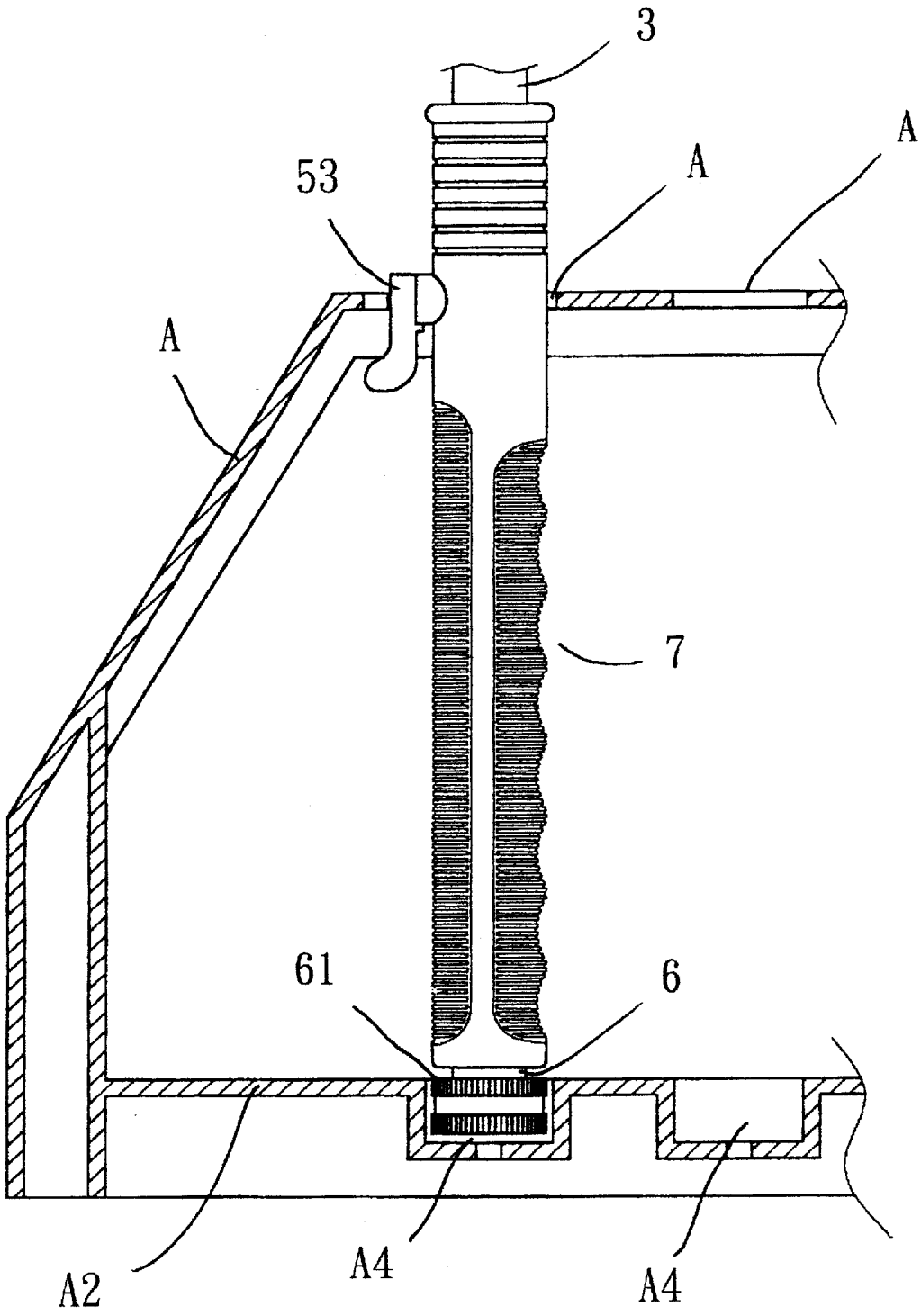
FIG. 11 is a schematic sectional view showing the bottom section of the long tube coupled to the switch and the handle, and the securing seat.

Referring to FIGS. 9, 10 and 11, in practice, when a number of the sprayers are held in the securing seat A, the top side of the securing seat A can be provided with a plurality of gourd-shaped through holes A3, and a plurality of positioning groove A4 are correspondingly formed in the base A2 of the securing seat A to align with the through holes A3 such that when the sprayers are inserted into the through holes A3 to be secured in the securing seat A, the switch 5 and the rotary knob 53 thereon together with the handle 7 at the front section of the tube 6 can be positioned at the corresponding through hole A3 to thereby properly position each sprayer.

When the sprayers are displayed in the securing seat A for sale, even if a consumer removes the sprayer from the securing seat A for inspection, since the switch 5 is integrally formed with the long tube 3 and the handle 7, the switch 5 will not become disengaged, thereby eliminating the problem associated with the prior art.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A switch handle mounted at a bottom section of a sprayer long tube of a water sprayer, comprising a sprayer long tube, a switch and an inlet tube having a connecting sleeve pivotally connected to a bottom end of the switch, wherein a bottom section of the sprayer long tube is connected to an outlet section of the switch, and an inlet section of the switch is connected to the inlet tube having a suitable length, the sprayer long tube, switch and inlet tube being connected integrally, and a connecting section of the bottom section of the sprayer long tube and the switch, a periphery of the switch, a connecting section of the switch and the inlet tube, and an entire peripheral surface of the tube being injection molded integrally from plastic (or rubber) by injection molding one or two times, to thereby effectively couple them integrally such that the plastic (or rubber) injection molded parts are used by a handle provided at the bottom section of sprayer long tube, whereby the handle will not rotate or slide up and down, and the switch which controls water to flow into the sprayer long tube is disposed on a periphery of a front section of the handle which is mounted to a bottom section of the sprayer long tube so that the user uses the hand to hold the handle to directly manipulate the switch as in use; and wherein a plurality of water stopping annular grooves for fitting a plurality of water stop rings and a plurality of positioning annular grooves are formed on extending sections extending from inlet and outlet sections of the switch, and a front section of the inlet tube and the bottom section of the sprayer long tube are respectively fitted on the peripheries of the extending sections of the inlet and outlet sections of the switch, positioning rings are directly formed at positions corresponding to the positioning annular grooves provided on the extending sections, so that the front section of the inlet tube and the bottom section of the sprayer long tube are insertably coupled with the inlet and outlet sections, thereby achieving effective connection among the sprayer long tube, the switch and the inlet tube.

2. The switch handle as claimed in claim 1 wherein the suitable extending section of the inlet and outlet sections of switch are respectively and directly provided with threaded sections, and a front section of the inlet tube and the bottom section of the sprayer long tube are respectively provided with threaded sections to achieve effective connection among the sprayer long tube, the switch and the inlet tube.

* * * * *